US005090176A

United States Patent [19]

Kishida et al.

[11] Patent Number: 5,090,176

[45] Date of Patent: Feb. 25, 1992

[54] METHOD OF POSITIONING CONCRETE SLABS ON GIRDERS

[75] Inventors: Hiroo Kishida; Hirofumi Takenaka, both of Osaka, Japan

[73] Assignee: Harumoto Iron Works Co., Ltd., Osaka, Japan

[21] Appl. No.: 524,048

[22] Filed: May 16, 1990

[30] Foreign Application Priority Data

Feb. 20, 1990 [JP] Japan ..... 2-40609

[51] Int. Cl.[5] ..... E04B 1/06; E04C 3/20

[52] U.S. Cl. ..... 52/745; 52/334

[58] Field of Search ..... 52/745, 747, 79.1, 79.14; 14/1, 16

[56] References Cited

U.S. PATENT DOCUMENTS 3,225,434 12/1965 van der Lely ..... 52/79.1
3,570,207 3/1971 Launay ..... 52/745
4,006,574 2/1977 van der Lely ..... 52/745
4,054,014 10/1977 van der Lely ..... 52/745
4,697,397 10/1987 Okuda ..... 52/745

FOREIGN PATENT DOCUMENTS 1339695 9/1963 France ..... 52/745

*Primary Examiner*—John E. Murtagh
*Attorney, Agent, or Firm*—Wenderoth, Lind & Ponack

[57] ABSTRACT

A method of installing concrete slabs on girders includes arranging a girder to extend along a moving direction of slabs to be installed. A first slab then is positioned at a mounting position at an upstream end, relative to the moving direction, of the girder. The first slab then is moved from the mounting position in the downstream direction by a predetermined distance. Another slab then is positioned at the mounting position after removal therefrom of the first slab. Then another slab is moved in the downstream direction together with the first slab. The operations of positioning slabs and moving the slabs in the downstream direction are repeated until the installation is completed.

12 Claims, 6 Drawing Sheets

Fig. 2 (1)
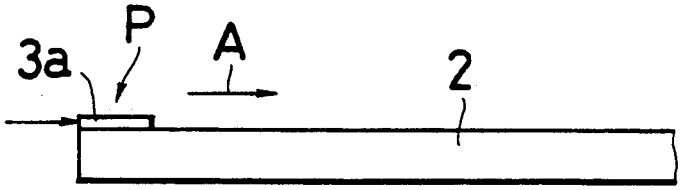
Fig. 2 (2)
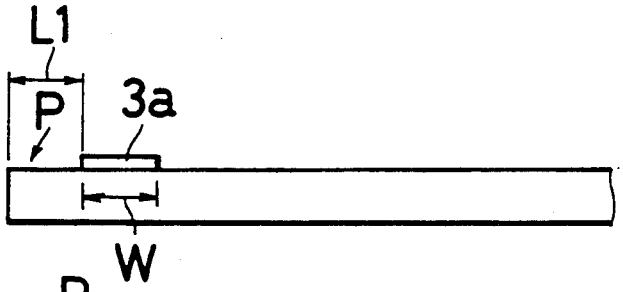
Fig. 2 (3)
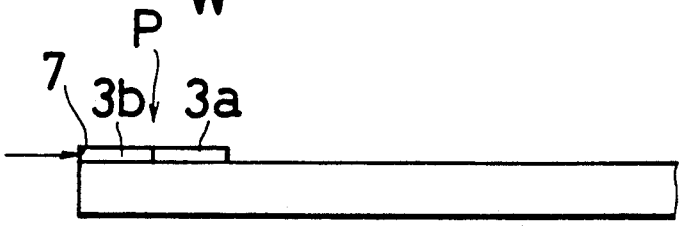
Fig. 2 (4)
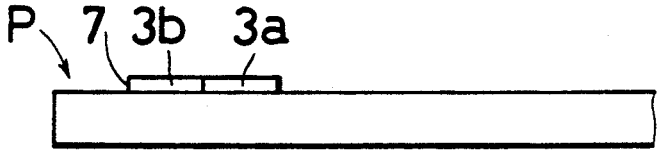
Fig. 2 (5)
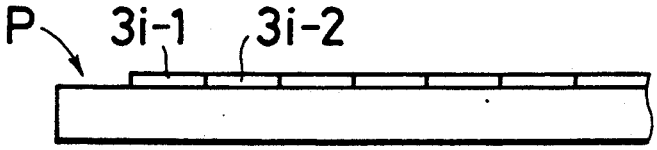
Fig. 2 (6)
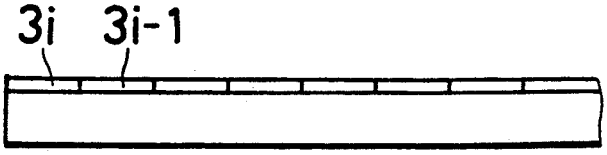

METHOD OF POSITIONING CONCRETE SLABS ON GIRDERS

BACKGROUND OF THE INVENTION

1. Field of the Invention

The present invention relates to a method of laying or positioning members such as concrete slabs on base members such as steel girders or concrete girders.

2. Description of the Prior Art

Conventionally, to position or lay concrete slabs or other members on base members such as steel girders, forms are constructed or set up along the base members, and fluid concrete is filled into such forms. In other words, the concrete slabs are constructed in-site in place on the girders.

In such prior art method, where the length of the installation being constructed is very long, the forms and the concrete source must be delivered to the slab forming positions extending over a very long distance. Accordingly, the efficiency of the installation operation is poor. Also, in a relatively narrow working space such as the inside of a tunnel, a relatively large portion of such space is occupied by the assembled forms.

SUMMARY OF THE INVENTION

It is hence a primary object of the invention to provide a method of laying or positioning and installing such members efficiently without requiring that a large space be occupied by the structure for such method.

To achieve the above object, the invention provides a method comprising:

a first step of arranging base members such as steel or concrete girders along moving direction of members, a second step of positioning members such as concrete slabs mounting positions at an upstream end of the base members relative to the moving direction, a third step of moving the members positioned at the mounting positions to a downstream position in the moving direction by a predetermined length, and a fourth step of positioning other members at the mounting positions after movement therefrom of the first mentioned members, and moving such other members in the downstream direction together with the first mentioned member, wherein the third step and fourth steps are repeated, and plural members are installed on the base members.

According to the invention, since multiple members are installed by placing the members sequentially at the mounting positions at the upstream location, relative to the moving direction, of the base members and moving them to the downstream location in the moving direction, a relatively small space is occupied and needed for the structure for carrying out the method, and only at the mounting positions. Also, since the members are moved either by being pushed or pulled from the mounting positions, even if the length of the installation is relatively long, it is not necessary to carry the members to positions, all along the installation, and the efficiency of operation is enhanced. Further, since as wide working space is not needed, other operations may be done simultaneously while positioning the members, and by making use of the installed members, the space required for the other operations also may be maintained. Moreover, the invention involves a repetition of simplified operations positioning and pushing or pulling the members from the mounting positions, and thereby control of the operation and installation is simplified. In addition, the members moved to the installed positions thereof may be directly used as working space or paths for other operations, and the convenience thus is enhanced.

BRIEF DESCRIPTION OF THE DRAWINGS

Other and further objects, features, and advantages of the invention will be more explicit from the following detailed description taken with reference to the drawings, wherein:

FIGS. 2(1)–2(6) are schematic views explaining a procedure for installing precast slabs;

DETAILED DESCRIPTION OF THE PREFERRED EMBODIMENTS

Figure 1:
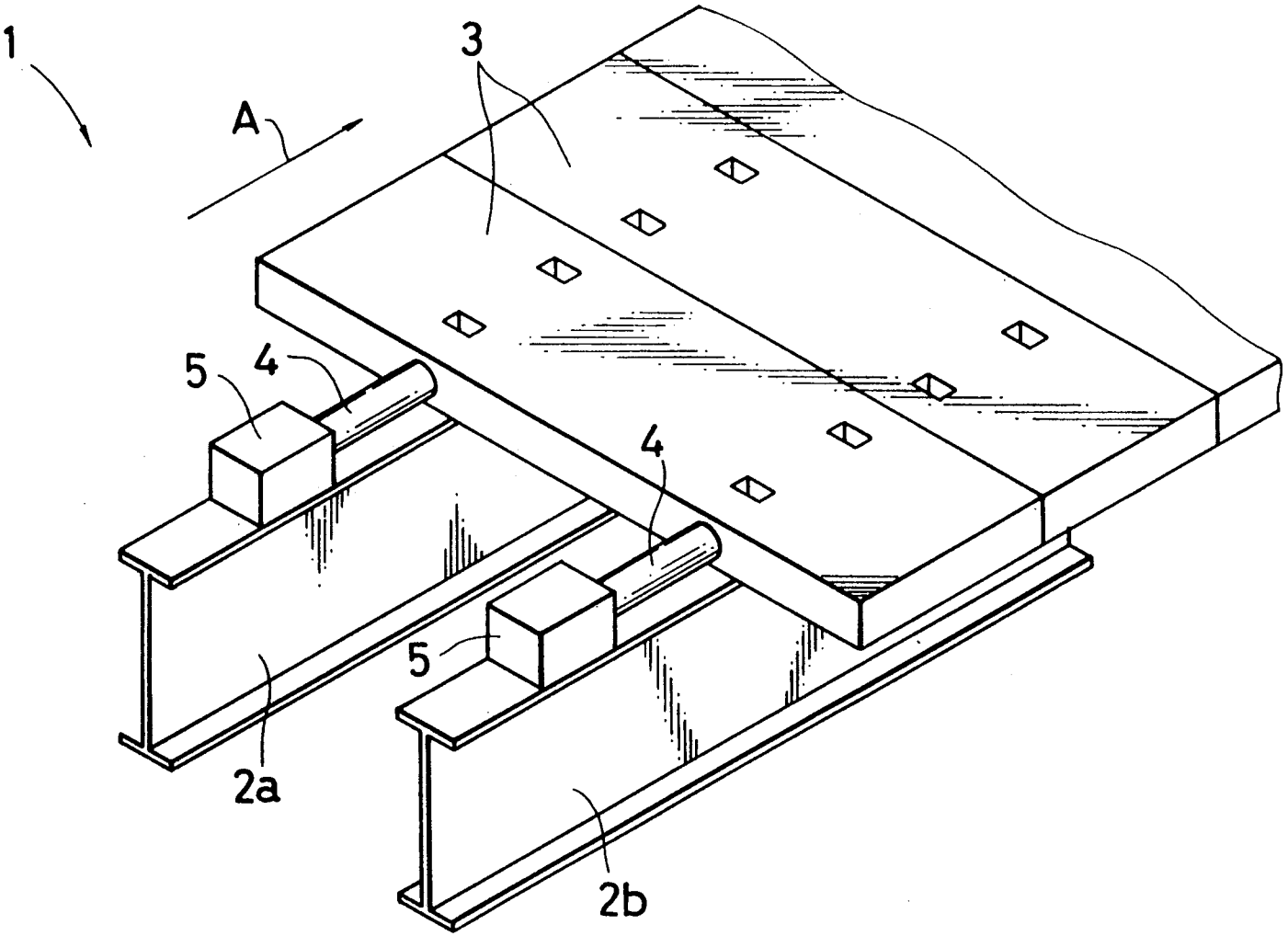
FIG. 1 of the perspective view showing an installing method of one embodiment of the invention.

Now referring to the drawing, preferred embodiments of the invention are described below.

FIG. 1 is a perspective view showing an embodiment of the invention. Multiple parallel steel base members such as girders 2*a*, 2*b* are installed on a bridge 1, and multiple members, that is precast concrete slabs 3, are laid on the base members 2*a*, 2*b*. Such precast slabs 3 are pushed in a direction downstream relative to a moving direction A by, for example, hydraulic jacks 4. Jacks 4 are provided to act against steel pressure-supporting members 5 that receive reaction forces of jacks 4 to enable pushing of the precast slabs 3.

Figure 3:
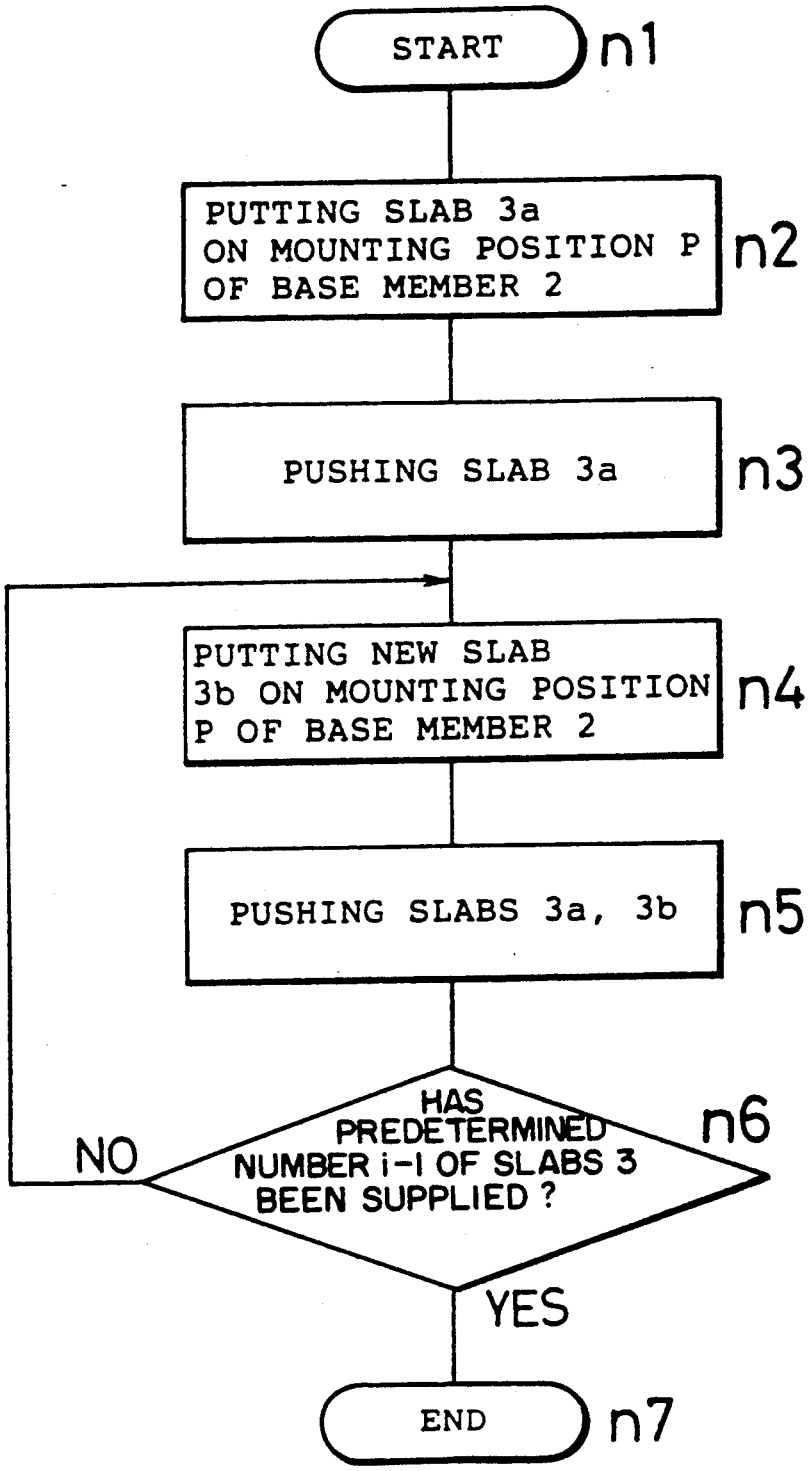
FIG. 3 is a flow chart illustrating such procedure.

FIGS. 2(1)–2(6) explain a procedure for positioning or installing the precast slabs 3, and FIG. 3 is a flow chart illustrating such procedure. When the job is started at step n1 with base member 2 positioned, at step n2 a first precast slab 3*a* is put in a mounting position P on the base members 2 as shown in FIG. 2(1). This mounting position P is selected, for example, at the upstream end of base members 2 with respect to moving direction A, and the precast slabs 3 are positioned by means of crane or the like. When the first precast slab 3*a* is positioned at mounting position P, then at step n3 the precast slab 3*a* is pushed in the downstream direction by the jacks 4. The length L1 of movement of the precast slab 3*a* during such pushing is selected to be nearly equal to or slightly larger than the width W of precast slab 3*a* the moving direction A.

Thus, as shown in FIG. 2(2), after step n3 the mounting position P will be vacant due to moving the precast slab 3*a* therefrom, and a precast slab 3*b* is mounted thereat at step n4 as shown in FIG. 2(3). Subsequently, at step n5, as shown in FIG. 2(4), the end face 7 of the upstream side of the precast slab 3*b* mounted at step n4 is pushed, together with the precast slabs 3*a*, in the downstream direction.

At step n6, it is judged whether the number of precast slab 3 supplied in the above manner has reached a specified number (i − 1). If not, then the operation returns to step n4, and a new precast slab is put on the mounting position P, and at step n5 it is pushed by the jacks 4. The operations from step n4 to step n6 are repeated until the specified number (i − 1) has been reached. Thus, when the specified number (i − 1) of preset slabs have been supplied, as shown in FIG. 2(5) at step n6, the operation moves to step n7, where the final precast slab 3*i* is placed on the mounting position P, thereby completing the laying operation as shown in FIG. 2(6).

Figure 4:
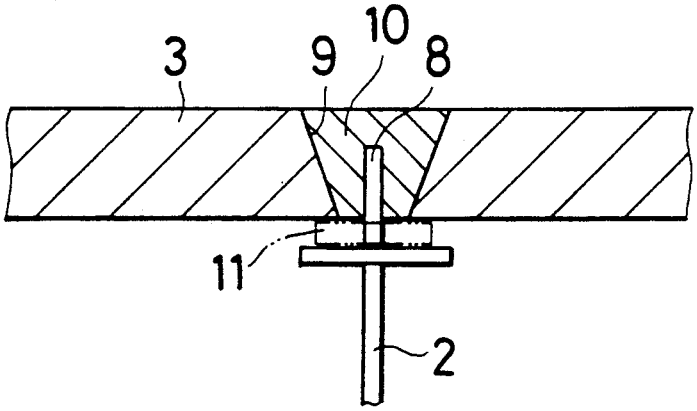
FIG. 4 is a sectional view showing an arrangement for fixing precast slabs and a base member.

When the precast slabs 3 thus are laid on the base members 2, then as shown in FIG. 4, a stud 8 buried in the base member 2 is penetrated through a hole 9 preliminarily formed in the precast slab. A filler such as cement mortar 10 is charged into hole 9 to fill up and harden therein, so that the base member 2 and the precast slab 3 are integrally attached. Fixing of each base member 2 to each of the precast slabs 3 may be achieved according to the method of the invention.

Figure 5:
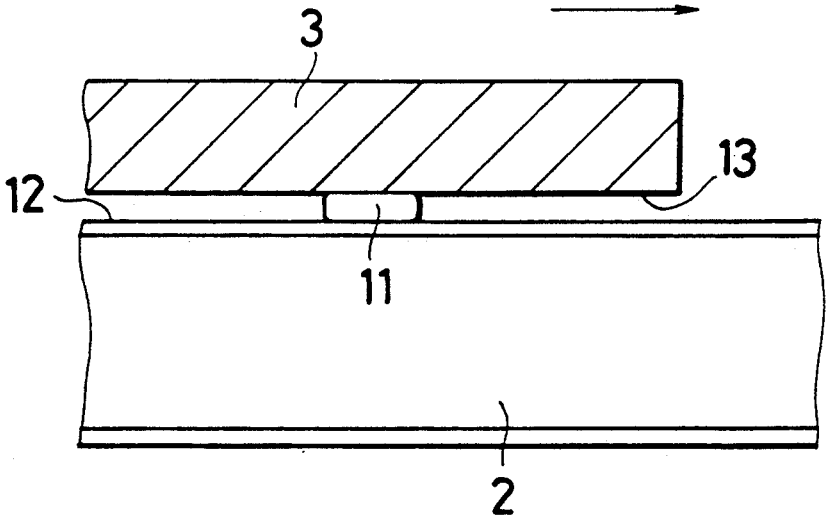
FIG. 5 is a side view or an interface member placed between a slab and a base member.

When moving the precast slab 3 on the base member 2, as shown in FIG. 5 an intervening member 11 made of a material having a relatively low friction coefficient, for example, fluororesin (tradename: Teflon) is placed between the upper surface 12 of the base member 2 and the lower surface 13 of the precast slab 3. As a result, each precast slab 3 easily can be moved by sliding smoothly over the upper surface 12 of the base member 2 in the moving direction A, together with the intervening member 11. Accordingly, only a small pushing force is required from the jacks 4. Consequently, the structure of the supporting members 5 resisting the reaction forces from the jacks 4 may be reduced in size, and the entire structure for moving the precast slab 3 hence may be reduced in size. With the precast slab 3 being pushed from an upstream position, even if the upper surfaces 12 of the base members 2 slope upwardly from such upstream position, the slabs 3 will not move in a reverse direction.

Figure 6:
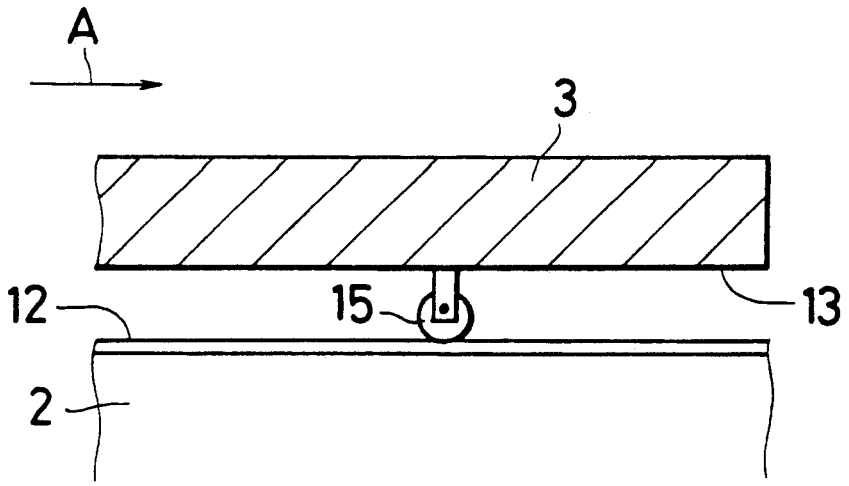
FIG. 6 is a side view near a roller in another embodiment of the invention.
Figure 7:
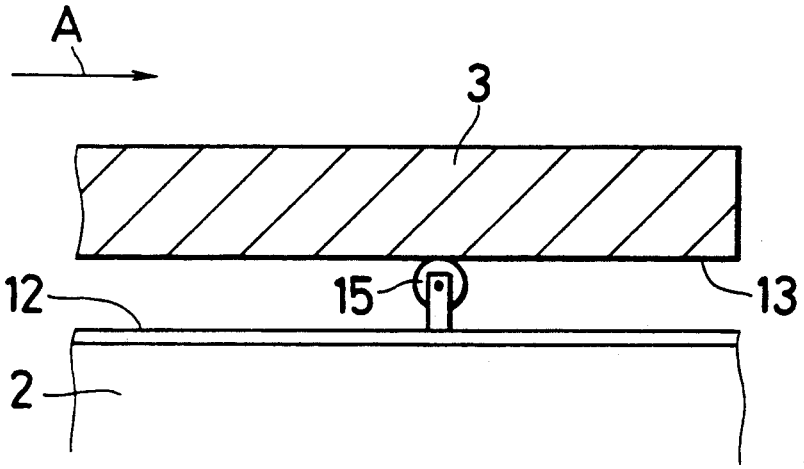
FIG. 7 is a side view near a roller in still a different embodiment of the invention.

In another embodiment of the invention shown in FIG. 6, a roller 14 may be installed on the lower surface 13 of the precast slab 3, to facilitate movement of the precast slab 3, together with roller 15, in the downstream direction A over the upper surface 12 of the base member 2. Furthermore, as shown in FIG. 7, roller 15 may be installed on the upper surface 12 of the base member 2, and the precast slab 3 may be moved over the roller 15. Roller 15 reduce the friction resistance in moving the precast slab 3 so that the precast slab 3 may be moved easily in the downstream direction A.

Figure 8:
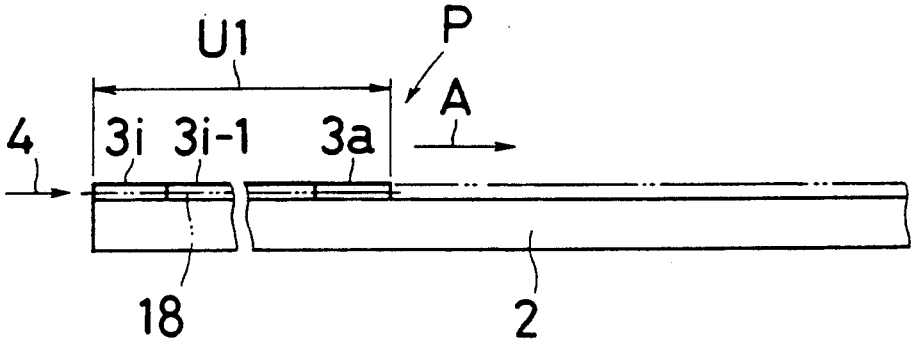
FIG. 8 is a schematic view explaining a method of another embodiment of the invention.

FIG. 8 schematically illustrates a laying method of another embodiment of the invention. In this embodiment, multiple precast slabs 3*a* to 3*i* are placed on the base members 2 by the same procedure as in the embodiment shown in FIGS. 2(1) through FIG. 3. Such precast slabs 3*a* to 3*i* then are connected by PC steel wires 18 to form a unit U1. This entire connected unit U1 then is moved by being pushed in the downstream direction A by the jack 4. Thus, movement is carried out on each unit after bundling multiple precast slabs 3. In this way, it is not necessary to move the precast slabs 3, PC steel wires 18 and a tightening device therefor over the entire long length structure, e.g. on the a bridge 1, and the speed of installation can be improved substantially.

In a further different embodiment of the invention, as a modification of the embodiment shown in FIG. 8, the precast slabs 3*a* to 3*i* of one unit U1 may be connected by PC steel wires 18 at location different from the mounting position P, and then such connected unit can be positioned on the mounting position P on the base members 2 by use of a crane or the like.

Figure 9:
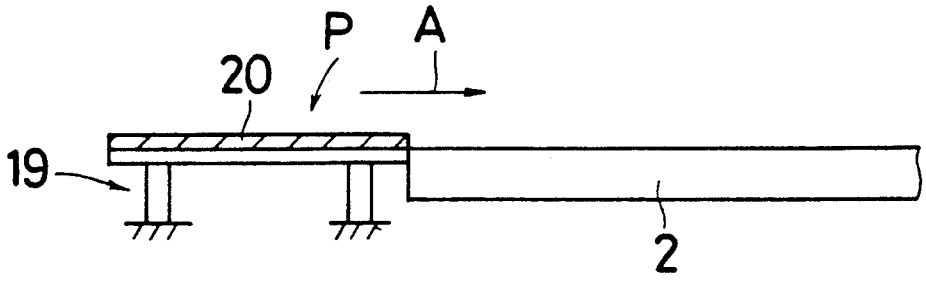
FIG. 9 is a schematic view explaining a method of further different embodiment of the invention.

FIG. 9 shows a laying method of still a different embodiment of the invention. At the upstream end, with respect to the moving direction A, of the base members 2, a fabrication yard 19 is set up by assembling multiple steel members including, e.g., covering plates. Forms or molds are set up on fabrication yard, and the concrete slabs 20 are manufactured thereat, and then are pushed and moved onto the base members 2 by the jacks 4. By fabricating such concrete cast slabs 20 in situ on the fabrication yard 19 and repeating the moving operations, multiple concrete slabs 20 may be positioned on the base members 2.

In another different embodiment of the invention, forms or molds are assembled at the mounting position P of the base members 2, concrete slabs 20 are fabricated in the forms, the forms are removed, and the thus fabricated slabs 20 are moved in the downstream direction A.

In the foregoing embodiments, the base members 2 are made of steel, but in other embodiments of the invention members 2 may concrete girders, or other members such as walls.

Furthermore, in the above embodiments the precast slabs 3 are moved by pushing in the downstream direction A by the jacks 4. However, it also is possible to move the slabs in the downstream direction A by installing pulling means at a downstream end position and thereby pulling the slabs in the moving direction A from the mounting position P. Such pulling means could be, for example, a take-up device having a wire cable or rope wound around a reel. An end of the wire rope could be connected to the precast slab 3, unit U1 or concrete slab 20 arranged at the mounting position P, and the reel could be operated to pull the rope and slab in the downstream direction.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claim is:

1. A method of constructing an elongated installation, such as a bridge or a tunnel, including girders extending in the elongated direction of the installation, and a plurality of precast concrete slabs forming a covering structure over said girders, each said slab extending laterally between and over said girders, and said slabs being aligned end-to-end along said elongated direction, said method comprising:

(a) arranging said girders to extend in said elongated direction from a first end of said installation to a second end thereof;

(b) providing a plurality of precast concrete slabs having holes formed therein;

(c) positioning at least one first precast concrete slab across said girders at a mounting position at said first end of said installation with an intervening member having a low coefficient of friction positioned between said slab and said girders;

(d) moving said first slab along said girders in a moving direction away from said mounting position toward said second end of said installation by a distance at least equal to the width of said first slab in said moving direction;

(e) positioning at least one another precast concrete slab across said girders at said mounting position with a said intervening member therebetween;

(f) moving said another slab along said girders in said moving direction away from said mounting position, and thereby causing said another slab to move said first slab further in said moving direction toward said second end of said installation;

(g) repeating steps (e) and (f) with successive additional at least one precast concrete slabs until said first slab is moved to a final position therefor at said second end of said installation and said slabs extend entirely along said girders between said first and second ends of said installation;

penetrating studs from said girders into said holes in said slabs; and charging a filler into said holes to fill said holes and to harden around said studs, thereby integrally attaching said slabs to said girders.

2. A method as claimed in claim 1, wherein said girders comprise steel girders.

3. A method as claimed in claim 1, wherein said girders comprise concrete girders.

4. A method as claimed in claim 1, wherein said moving comprises pushing said slab at said mounting position therefrom in said moving direction.

5. A method as claimed in claim 4, wherein said pushing comprises operating jacks mounted on said girders.

6. A method as claimed in claim 1, wherein said moving comprises pulling said slab at said mounting position therefrom in said moving direction.

7. A method as claimed in claim 1, wherein said at least one slab positioned on said girders at said mounting position comprises a single slab.

8. A method as claimed in claim 1, wherein said at least one slab positioned on said girders at said mounting position comprise plural preassembled slabs.

9. A method as claimed in claim 1, further comprising assembling pluralities of said slabs, after positioning thereof on said girders, into connected units of slabs, and moving said units of slabs in said moving direction.

10. A method as claimed in claim 1, comprising providing each said slab with a number of said holes at least equal to the number of said girders.

11. A method as claimed in claim 1, comprising providing said studs to be embedded in said girders.

12. A method as claimed in claim 1, comprising extending said studs through said intervening members, such that said intervening members are integrally fixed between said slabs and said girders.

* * * * *